US007156955B2

(12) United States Patent
Nyander et al.

(10) Patent No.: US 7,156,955 B2
(45) Date of Patent: Jan. 2, 2007

(54) PAPERMAKING PROCESS USING A SPECIFIED NSF TO SILICA-BASED PARTICLE RATIO

(75) Inventors: Johan Nyander, Sollentuna (SE); Hans Johansson-Vestin, Kungälv (SE); Jan Nordin, Kvissleby (SE); Annika Viola Pal, Partille (SE)

(73) Assignee: Akzo Nobel N.V., Arnhem (NL)

( * ) Notice: Subject to any disclaimer, the term of this patent is extended or adjusted under 35 U.S.C. 154(b) by 276 days.

(21) Appl. No.: 10/326,316

(22) Filed: Dec. 20, 2002

(65) Prior Publication Data

US 2003/0139517 A1 Jul. 24, 2003

Related U.S. Application Data

(60) Provisional application No. 60/342,344, filed on Dec. 21, 2001.

(51) Int. Cl.
*D21F 11/00* (2006.01)
*D21H 21/00* (2006.01)

(52) U.S. Cl. ..... 162/158; 162/168.3

(58) Field of Classification Search ..... 162/158, 162/181.6, 165, 175, 168.3
See application file for complete search history.

(56) References Cited

U.S. PATENT DOCUMENTS

| | | | | |
|---|---|---|---|---|
| 4,070,236 | A | 1/1978 | Carrard et al. | 162/164 R |
| 4,388,150 | A | 6/1983 | Sunden et al. | 162/175 |
| 4,443,496 | A | 4/1984 | Obitsu et al. | 427/140 |
| 4,559,241 | A | 12/1985 | Obitsu et al. | 427/140 |
| 4,750,974 | A * | 6/1988 | Johnson | 162/164.1 |
| 4,772,332 | A | 9/1988 | Nemeh et al. | 106/487 |
| 5,110,414 | A | 5/1992 | Forss et al. | 162/163 |
| 5,176,891 | A | 1/1993 | Rushmere | 423/328.1 |
| 5,368,833 | A | 11/1994 | Johansson et al. | 423/338 |
| 5,447,604 | A | 9/1995 | Johansson et al. | 162/181.6 |
| 5,595,629 | A | 1/1997 | Begala | 162/158 |
| 5,603,805 | A | 2/1997 | Andersson et al. | 162/168.3 |
| 5,733,414 | A | 3/1998 | Stockwell | 162/164.5 |
| 6,033,524 | A | 3/2000 | Pruszynski et al. | 162/165 |
| 6,083,997 | A * | 7/2000 | Begala et al. | 516/79 |
| 6,165,259 | A | 12/2000 | Hällström et al. | 106/243 |
| 6,331,229 | B1 * | 12/2001 | Wong Shing et al. | 162/168.3 |
| 6,432,271 | B1 * | 8/2002 | Wong Shing et al. | 162/168.3 |
| 6,451,169 | B1 * | 9/2002 | Ward et al. | 162/164.1 |
| 6,893,538 | B1 * | 5/2005 | Greenwood et al. | 162/181.6 |

FOREIGN PATENT DOCUMENTS

| | | |
|---|---|---|
| EP | 418 015 A1 | 3/1991 |
| GB | 2 294 708 A | 5/1996 |

OTHER PUBLICATIONS

European Search Report for the European Application No. EP 01 85 0225 dated Mar. 27, 2002.
Iler et al., "Degree of Hydration of Particles of Colloidal Silica in Aqueous Solution," J. Phys. Chem, vol. 60, (1956), pp. 955-957.
Sears Jr., G., "Determination of Specific Surface Area of Colloidal Silica by Titration with Sodium Hydroxide," Analytical Chem., vol. 28, No. 12 (1956), pp. 1981-1983.
International Search Report for International Application No. PCT/SE 02/02443 dated May 8, 2003.

* cited by examiner

*Primary Examiner*—Eric Hug
*Assistant Examiner*—Carlos Lopez
(74) *Attorney, Agent, or Firm*—Michelle J. Burke; David H. Vickrey; Robert C. Morriss

(57) ABSTRACT

The present invention refers to a process for the production of paper from a suspension containing cellulosic fibers, and optionally fillers, comprising adding to the suspension at least one cationic organic polymer and an aqueous silica-containing composition comprising an anionic naphthalene sulphonate formaldehyde condensate and anionic silica-based particles, the composition having a weight ratio of naphthalene sulphonate formaldehyde condensate to silica-based particles within the range of from 0.2:1 to 99:1, and containing naphthalene sulphonate formaldehyde condensate and silica-based particles in an amount of at least 0.01% by weight, based on the total weight of the aqueous silica-containing composition, and with the proviso that the composition contains substantially no cellulose-reactive sizing agent. The invention also encompasses an aqueous silica-containing composition and a method for preparation of an aqueous silica-containing compound.

20 Claims, No Drawings

PAPERMAKING PROCESS USING A SPECIFIED NSF TO SILICA-BASED PARTICLE RATIO

This application claims priority of U.S. Provisional Patent Application No. 60/342,344 filed Dec. 21, 2001.

The present invention relates to a process for the production of paper from a suspension containing cellulosic fibres, comprising adding at least one cationic organic polymer and an aqueous silica-containing composition comprising an anionic naphthalene sulphonate formaldehyde condensate and anionic silica-based particles. The invention further relates to an aqueous silica-containing composition and methods for the preparation of the aqueous silica-containing composition, and uses of the aqueous silica-containing composition.

BACKGROUND OF THE INVENTION

In the papermaking art, an aqueous suspension containing cellulosic fibres, and optionally fillers and additives, referred to as stock, is fed into a headbox which eje cts the stock onto a forming wire. Water is drained from the stock through the forming wire, so that a wet web of paper is formed and dewatered on the wire. The paper web is then dried in the drying section of the paper machine. Drainage and retention aids are conventionally introduced into the stock in order to facilitate drainage and to increase adsorption of fine particles onto the cellulosic fibres to retain them with the fibres on the wire.

U.S. Pat. No. 4,388,150 discloses a binder in papermaking comprising a complex of cationic starch and colloidal silicic acid to produce a paper having increased strength and improved levels of retention of added minerals and papermaking fines.

U.S. Pat. No. 4,750,974 discloses a coarcervate binder for use in papermaking comprising a tertiary combination of a cationic starch, an anionic high molecular weight polymer and a dispersed silica.

U.S. Pat. No. 5,368,833 discloses silica sols containing aluminium modified silica particles with high specific surface area and a high content of microgel.

U.S. Pat. No. 6,083,997 discloses anionic nano-composites, which are prepared by adding a polyelectrolyte to silicate solution and then combining them with silicic acid. The nano-composites exhibit retention and drainage performance in papermaking.

EP 0 418 015 A1 discloses an active sizing composition containing an aqueous emulsion in combination with an anionic dispersant or emulsifier. By using anionic polyacrylamide, anionic starch or colloidal silica the anionic charge density in the sizing composition can be extended.

U.S. Pat. No. 4,443,496 refers to a method for modifying a surface layer of handened cement or substrates with use of the agent which comprises in a specified ratio of an alkali silicate solution and a sodium naphthalene sulphonate formaldehyde condensate.

U.S. Pat. No. 4,559,241 relates to an aqueous solution of alkali metal silicate and nitrite. The solution may also contain additives such as formaldehyde condensate with naphthalene sulphonate.

U.S. Pat. No. 5,595,629 refers to a papermaking process comprising adding to the slurry an anionic polymer and cationic polymer in order to increase retention and/or dewatering. The anionic polymer comprises a formaldehyde condensate of naphthalene sulfonic acid salt with a molecular weight range of 500 to 120,000.

U.S. Pat. No. 6,033,524 discloses a method for increasing retention and drainage of filling components in a paper making furnish in a paper making process comprising adding to the furnish a slurry of filling components, also containing a phenolic enhancer.

U.S. Pat. No. 4,772,332 pertains to a heat stabilised slurry of bulked kaolin pigment which is prepared by mixing a water soluble cationic material with kaolin clay pigment in the presence of water.

U.S. Pat. No. 5,733,414 relates to a process for manufacturing paper from a cellulosic suspension comprising adding a water soluble cationic polymer and a water soluble formaldehyde condensate resin.

U.S. Pat. No. 5,110,414 discloses a procedure for manufacturing lignocellulosic material products and improving their strength and water resistant characteristics, high molar mass lignin derivatives being added to the material.

It would be advantageous to be able to provide drainage and retention aids with improved performance. It would also be advantageous to be able to provide retention and drainage aids with good storag e stability. It would further be advantageous to be able to provide a papermaking process with improved drainage and/or retention performance.

THE INVENTION

According to the present invention it has unexpectedly been found that an improved drainage and/or retention effect of a cellulosic suspension on a wire can be obtained by using an aqueous silica-containing composition comprising anionic naphthalene sulphonate formaldehyde condensate and silica-based particles. The present invention makes it possible to increase the speed of the paper machine and to use a lower dosage of additives to give a corresponding drainage and/or retention effect, thereby leading to an improved paper making process and economic benefits.

The terms "drainage and retention aid", as used herein, refer to one or more components, which when added to an aqueous cellulosic suspension, give better drainage and/or retention than obtained when not adding the said one or more components. All types of stocks, in particular stocks having high contents of salts (high conductivity) and colloidal substances will obtain better drainage and retention performances by the addition of the composition according to the present invention. Improved drainage and retention performances are important in papermaking processes for instance in processes with a high degree of white water closure, i.e. extensive white water recycling and limited fresh water supply.

In accordance with the present invention there is provided a process for the production of paper from a suspension containing cellulosic fibres, and optionally fillers, comprising adding to the suspension at least one cationic organic polymer and an aqueous silica-containing composition comprising an anionic naphthalene sulphonate formaldehyde condensate and anionic silica-based particles, the composition having a weight ratio of naphthalene sulphonate formaldehyde condensate to total amount of silica-based particles within the range of from 0.2:1 to 99:1, and containing naphthalene sulphonate formaldehyde condensate and total amount of silica-based particles in an amount of at least 0.01% by weight, based on the total weight of the aqueous silica-containing composition, and with the proviso that the composition contains substantially no cellulose-reactive sizing agent.

There is further provided an aqueous silica-containing composition comprising an anionic naphthalene sulphonate formaldehyde condensate and anionic silica-based particles comprising aggregated or microgel formed silica-based particles, the composition having a weight ratio of naphthalene sulphonate formaldehyde condensate to total amount of silica-based particles within the range of from 0.2:1 to 99:1, and containing naphthalene sulphonate formaldehyde condensate and total amount of silica-based particles in an amount of at least 0.01% by weight, based on the total weight of the aqueous silica-containing composition, and with the proviso that the composition contains substantially no cellulose-reactive sizing agent.

There is further provided an aqueous silica-containing composition obtainable by mixing anionic naphthalene sulphonate formaldehyde condensate with an aqueous alkali stabilised sol containing aggregated or microgel formed silica-based particles having an S-value in the range of from about 5 up to about 50%, to provide an aqueous silica-containing composition containing an anionic naphthalene sulphonate formaldehyde condensate and total amount of silica-based particles in an amount of at least 0.01% by weight, based on the total weight of the aqueous silica -containing composition, with the proviso that the aqueous silica-containing composition contains substantially no cellulose-reactive sizing agent.

There is further provided a method for preparation of an aqueous silica-containing composition, which comprises mixing in the presence of substantially no cellulose-reactive sizing agent an anionic naphthalene sulphonate formaldehyde condensate with an aqueous alkali stabilised sol containing aggregated or microgel formed silica-based particles having an S-value in the range of from about 5 up to about 50% to provide an aqueous silica-containing composition having a weight ratio of naphthalene sulphonate formaldehyde condensate to total amount of silica-based particles within the range of from 0.2:1 to 99:1, and containing naphthalene sulphonate formaldehyde condensate and total amount of silica-based particles in an amount of at least 0.01% by weight.

There is further provided a method for preparation of an aqueous silica-containing composition, which comprises mixing an aqueous anionic naphthalene sulphonate formaldehyde condensate solution having a conductivity less than 20 mS/cm with an aqueous alkali stabilised sol containing silica-based particles to provide an aqueous silica-containing composition containing naphthalene sulphonate formaldehyde condensate and total amount of silica-based particles in an amount of at least 0.01% by weight.

There is further provided a method for preparation of an aqueous silica-containing composition, which comprises desalinating of an aqueous anionic naphthalene sulphonate formaldehyde condensate solution, mixing the desalinated aqueous anionic naphthalene sulphonate formaldehyde condensate solution with an aqueous alkali stabilised sol containing silica-based particles to provide an aqueous silica-containing composition containing naphthalene sulphonate formaldehyde condensate and total amount of silica-based particles in an amount of at least 0.01% by weight.

There is further provided a method for preparation of an aqueous silica-containing composition, which comprises mixing in the presence of substantially no cellulose-reactive sizing agent an anionic naphthalene sulphonate formaldehyde condensate with an aqueous alkali stabilised sol containing aggregated or microgel formed silica-based particles having an S-value in the range of from about 5 up to about 50%, to provide an aqueous silica-containing composition containing naphthalene sulphonate formaldehyde condensate and total amount of silica-based particles in an amount of at least 0.01% by weight There is further provided an aqueous silica-containing composition obtainable by the methods according to the invention.

The invention further relates to the use of the aqueous silica-containing composition of the invention, as flocculating agent in the production of pulp and paper and for water purification.

The process for the production of paper according to the present invention comprises adding to the suspension at least one cationic organic polymer and an aqueous silica-containing composition comprising anionic naphthalene sulfonate formaldehyde condensate and silica-based particles. The term "anionic naphthalene sulfonate formaldehyde condensate" as used herein, represent a group of po lymers obtained by condensation polymerisation of formaldehyde with one or more naphthalene sulphonic acids or salts thereof.

The naphthalene sulfonate formaldehyde condensate may be reacted with a base, such as alkali metal and alkaline earth hydroxides, e.g. sodium hydroxide, ammonia or an amine, e.g. triethylamine, thereby forming an alkali metal, alkaline earth or ammonium counter-ion.

The anionic naphthalene sulfonate formaldehyde condensate has a molecular weight of at least about 500, preferably from about 1,000. The upper limit is not critical it can be up to 1,000,000, usually up to 300,000, preferably up to 150,000 and preferably up to 60,000.

The aqueous silica-containing composition used in the process according to the invention also comprises anionic silica-based particles i.e. particles based on $SiO_2$, preferably formed by polymerising silicic acid, encompassing both homopolymers and copolymers. Optionally the silica-based particles can be modified and contain other elements, e.g. amine, aluminium and/or boron, which can be present in the aqueous phase and/or in the silica-based particles.

Examples of suitable silica-based particles include colloidal silica, colloidal aluminium-modified silica or aluminium silicate, and different types of polysilicic acid and mixtures thereof, either alone or in combination with other types of anionic silica-based particles. In the art, polysilicic acid is also referred to as polymeric silicic acid, polysili cic acid microgel, polysilicate and polysilicate microgel, which are all encompassed by the term polysilicic acid used herein. Aluminium-containing compounds of this type are commonly referred to as polyaluminosilicate and polyaluminosilicate microgel including colloidal aluminium-modified silica and aluminium silicate.

It is preferred that the anionic silica-based particles are in the colloidal range of particle size, i.e. colloidal silica-based particles. This colloidal state comprises particles sufficiently small not to be affected by gravitational forces but sufficiently large not to show marked deviation from the properties of typical solutions, i.e. average particle size significantly less than 1 μm. The anionic silica-based particles have an average particle size preferably below about 50 nm, preferably below about 20 nm and more preferably in the range of from about 1 to about 50 nm, most preferably from about 1 nm up to about 10 nm. As conventional in silica chemistry, the particle size refers to the average size of the primary particles, which may be aggregated or non-aggregated.

Preferably the silica-based particles have a specific surface area larger than 50 $m^2/g$, preferably larger than 100 $m^2/g$. The specific surface area can be up to 1700 $m^2/g$, preferably up to 1300 $m^2/g$, and usually within the range from 300 to 1300 $m^2/g$, preferably from 500 to 1050 $m^2/g$. The specific surface area can be measured by means of titra tion with NaOH according to the method described by Sears, Analytical Chemistry 28(1956), 12, 1981–1983 or in U.S. Pat. No. 5,176,891. The given area thus represents the average specific surface area of the particles.

The aqueous silica-containing composition used in the proce ss according to the invention may have a weight ratio of anionic naphthalene sulphonate formaldehyde condensate to total amount of anionic silica-based particles within the range of from 0.2:1 to 99:1, preferably from 0.2:1 to 90:1, preferably from 0.25:1 to 85:1. The total weight of the anionic naphthalene sulphonate formaldehyde condensate and anionic silica-based particles contained in the aqueous silica-containing composition is at least 0.01% by weight, calculated on the total weight of the aqueous silica-containing composition, preferably the concentration of anionic naphthalene sulphonate formaldehyde condensate and anionic silica-based particles is within the range of 1 to 45% by weight, preferably within the range of 2 to 35% by weight, most prefer ably 5 to 30% by weight.

The aqueous silica-containing composition can have an anionic charge density of at least 0.1 meq/g, usually the charge is within the range of 0.1 to 6 meq/g, preferably within the range of 0.1 to 5 meq/g, preferably within the range of 0.2 to 4 meq/g, and most preferably of 0.2 to 3.5 meq/g.

The aqueous silica-containing composition according to the invention contains substantially no cellulose-reactive sizing agent. By substantially no means that less or equal to 10% by weight, preferably less than 5%, preferably less than 1% by weight of cellulose-reactive sizing agent is present in the aqueous silica-containing composition. Most preferably there is no cellulose-reactive sizing agent in the aqueous silica-containing composition.

According to a preferred embodiment of the present invention, the aqueous silica-containing composition contains substantially no nitrites. By substantially no means that less or equal to 10% by weight, preferably less than 5%, preferably less than 1% by weight of nitrites is present in the aqueous silica-containing composition. Most preferably there is no cellulose-reactive sizing agent in the aqueous silica-containing composition, i.e. the composition is free from nitrites. The term "nitrites" encompass all nitrites such as nitrites of ammonium, lithium, kalium, sodium, calcium, and magnesium.

The present invention relates further to a method for preparation an aqueous silica-containing composition. The two components are preferably stirred together. The anionic naphthalene sulfonate formaldehyde condensate can be added to an aqueous sol containing the silica-based particles or the silica-based particles can be added to an aqueous solution of naphthalene sulfonate formaldehyde condensate. Prior to mixing the anionic naphthalene sulfonate formaldehyde condensate with the silica-based particles, the aqueous solution of anionic naphthalene sulfonate formaldehyde condensate may be desalinated or deionisated. The desalination or deionisation can be carried out with dialysis, membrane filtration, ultra-filtration, reversed osmosis or ion exchange or the like. It is preferred that the desalination or deionisation is carried out by the use of ultra-filtration or dialysis.

The anionic naphthalene sulfonate formaldehyde condensate to be mixed with the silica-based particles has the previously mentioned properties and has a conductivity less than 30 mS/cm, suitable less than 25 mS/cm, preferably less than 20 mS/cm, and most preferably less than 15 mS/cm measured at an anionic naphthalene sulfonate formaldehyde condensate content of 10%. The conductivity is usually at least 1 mS/cm, preferably at least 3 mS/cm and preferably within the range of from 5 to 15 mS/cm, measured at an anionic naphthalene sulfonate formaldehyde condensate content of 10%.

The silica-based particles, preferably anionic, to be mixed with anionic naphthalene sulfonate formaldehyde condensate have the previously mentioned properties. Preferably, the silica-based particles are contained in a sol, preferably alkali stabilised, before mixing with anionic naphthalene sulfonate formaldehyde condensate. The sol may have an S-value in the range of from 5 to 50%, preferably from 8 to 45%, and most preferably from 10 to 30%. Calculation and measuring of t he S-value can be performed as described by Iler & Dalton in J. Phys. Chem. 60(1956), 955–957. The S-value indicates the degree of aggregate or microgel formation and a lower S -value is indicative of a higher degree of aggrega tion.

Preferably, the silica-based particles are aggregated or microgel formed silica-based particles.

Preferably the silica-based particles have a molar ratio $Si_2O:Na_2O$ less than 60, usually within the range 5 to 60, and preferably within the range from 8 to 55.

The anionic naphthalene sulphonate formaldehyde condensate is usually mixed with silica-based particles in a weight ratio within a range of from 0.2:1 to 99:1, preferably from 0.2:1 to 90:1, preferably from 0.25:1 to 85:1.

The products prepared by any of these method s exhibits an improved storage stability and therefore a better drainage and retention aid performance when stored.

The mixing procedure of above mention methods is preferably carried out in the presence of substantially no cellulose-reactive sizing agent. By substantially no means that less or equal to 10% by weight, preferably less than 5%, preferably less than 1% by weight of cellulose-reactive sizing agent is present. Most preferably there is no cellulose-reactive sizing agent present.

The present invention further relates to a process for the production of paper from an aqueous suspension containing cellulosic fibres. The process comprises adding to the suspension a cationic organic polymer and the aqueous silica-containing composition of the invention. The cationic organic polymer according to the invention can be linear, branched or cross-linked. Preferably the cationic polymer is water-soluble or water-dispersible.

Examples of suitable cationic polymers include synthetic organic polymers, e.g. step-growth polymers and chain-growth polymers, and polymers derived from natural sources, e.g. polysaccharides.

Examples of suitable cationic synthetic organic polymers include vinyl addition polymers such as acrylate- and acrylamide-based polymers, as well as cationic poly(diallyl dimethyl ammonium chloride), cationic polyethylene imines, cationic polyamines, polyamidoamines and vinylamide-based polymers, melamine-formaldehyde and urea-formaldehyde resins.

Examples of suitable polysaccharides include starches, guar gums, celluloses, chitins, chitosans, glycans, galactans, glucans, xanthan gums, pectins, mannans, dextrins, preferably starches and guar gums. Examples of suitable starches include potato, corn, wheat, tapioca, rice, waxy maize, barley, etc.

Cationic starches and cationic acrylamide-based polymers are preferred polymers according to the invention, and they can be used singly, together with each other or together with other polymers, particularly preferred are cationic starches and cationic acrylamide-based polymers having at least one aromatic group.

The cationic organic polymers can have one or more hydrophobic groups attached to them. The hydrophobic groups can be aromatic groups, groups comprising aromatic groups or non-aromatic groups, preferably the hydrophobic groups comprise aromatic groups. The hydrophobic group can be attached to a heteroatom, e.g. nitrogen or oxygen, the nitrogen optionally being charged, which heteroatom, in turn, it can be attached to the polymer backbone, for exam ple via a chain of atoms. The hydrophobic group may have at least 2 and usually at least 3 carbon atoms, preferably from 3 to 12 and preferably from 4 to 8 carbon atoms. The hydrophobic group is preferably a hydrocarbon chain.

Suitable dosages counted as dry substance based on dry pulp and optional filler, of the cationic polymer in the system is from 0.01 to 50 kg/t (kg/tonne, "metric ton") of, preferably from 0.1 to 30 kg/t and most preferably from 1 to 15 kg/t.

Suitable dosages counted as dry substances based on dry pulp and optional filler, of the aqueous silica-containing composition defined above in the system are from 0.01 to 15 kg/t, preferably from 0.01 to 10 kg/t calculated as an anionic naphthalene sulphonate formaldehyde condensate and anionic silica-based particles, and most preferably from 0.05 to 5 kg/t.

Suitable mineral fillers of conventional types may be added to the aqueous cellulosic suspension according to the invention. Examples of suitable fillers include kaolin, china clay, titanium dioxide, gypsum, talc and natural and synthetic calcium carbonates such as chalk, ground marble and precipitated calcium carbonate (PCC).

Further additives that are conventional in papermaking can of course be used in combination with the chemicals according to the invention, for example anionic trash catchers (ATC), wet strength agents, dry strength agents, optical brightening agents, dyes, aluminium compounds, etc. Examples of suitable aluminium compounds include alum, aluminates, aluminium chloride, aluminium nitrate, and polyaluminium compounds, such as polyaluminium chlorides, polyaluminium sulphates, polyaluminium compounds containing chloride and/or sulphate ions, polyaluminium silicate sulphates, and mixtures thereof. The polyaluminium compounds may also contain other anions than chloride ions, for example anions from sulfuric acid, phosphoric acid, or organic acids such as citric acid and oxalic acid. When employing an aluminium compound in the present process, it is usually preferably to add it to the stock prior to the polymer component and micro- or nano-particulate material. Suitable addition levels of aluminium containing compounds is at least 0.001 kg/t, preferably from 0.01 to 5 kg/t and more preferably from 0.05 to 1 kg/t, calculated as $Al_2O_3$ based on dry pulp and optional filler.

Examples of suitable anionic trash catchers include cationic polyamines, polymers or copolymers of quaternary amines, or aluminum containing compounds.

The process of this invention is used for the production of paper. The term "paper", as used herein, include not only paper and the production thereof, but also other web-like products, such as for example board and paperboard, and the production thereof. The invention is particularly useful in the manufacture of paper having grammages below 150 g/m$^2$, preferably below 100 g/m$^2$, for example fine paper, newspaper, light weight coated paper, super calendered paper and tissue.

The process can be used in the production of paper from all types of stocks, both wood containing and woodfree. The different types of suspensions of cellulose-containing fibres and the suspensions should preferably contain at least 25% by weight and preferably at least 50% of weight of such fibres, based on dry substance. The suspensions comprise fibres from chemical pulp such as sulphate, sulphite and organosolv pulps wood-containing or mechanical pulp such as thermomechanical pulp, chemo-thermomechanical pulp, refiner pulp and groundwood pulp, from both hardwood and softwood, and can also be based on recycled fibres, optionally from de-inked pulps, and mixtures thereof. Preferably the stock is a wood-containing stock, which have high contents of salts and therefore high conductivity.

The chemicals according to the present invention can be added to the aqueous cellulosic suspension, or stock, in conventional manner and in any order. It is usually preferably to add the cationic polymer to the stock before adding the aqueous silica-containing composition, even if the opposite order of addition may be used. It is further preferred to add the cationic polymer before a shear stage, which can be selected from pumping, mixing, cleaning, etc., and to add the aqueous silica-containing composition after that shear stage.

The aqueous silica-containing composition can be used as a flocculation agent in the treatment of water for the production of drinking water or as an environmental treatment of waters for instance in lakes. The composition can also be used as flocculation agent in the treatment of waste water or waste sludges.

The invention is further illustrated in the following examples, which are not intended to limit the scope thereof. Parts and % relate to parts by weight and % by weight, respectively, and all solutions are aqueous, unless otherwise stated. The units are metric.

EXAMPLE 1

Test samples of the aqueous silica-containing compositions according to the invention were prepared by mixing an aqueous solution of naphthalene sulphonate formaldehyde condensate (NSF) with a silica sol containing silica-based particles in different dosages under moderate stirring. Reference samples were also prepared under the same condition as the test samples. One sample of NSF was ultra-filtrated and the obtained product (NSF I) had a concentration of 12% by weight and the samples were diluted to a concentration of 5% by weight and had a conductivity of 12 mS/cm. Another sample of NSF was dialysed and the obtained product (NSF II) had a concentration of 12% by weight and the samples were diluted to a concentration of 5% by weight and had a conductivity of 12 mS/cm. Untreated samples of NSF (NSF III) were diluted to a concentration of 5% by weight and had a conductivity of 25 mS/cm. All conductivities in the Examples were measured at a concentration of 10% by weight of NSF. The silicas used in the following Examples are all defined below in Table 1.

TABLE 1

| | |
|---|---|
| Silica I | Silica sol of the type described in U.S. Pat. No. 5,447,604 having a molar ratio $SiO_2$:$Na_2O$ of 10, specific surface area of 870 m$^2$/g, S-value of 35% and silica content of 10.0% by weight. |
| Silica II | Silica sol of the type described in U.S. Pat. No. 5,603,805 having a molar ratio $SiO_2$:$Na_2O$ of 45, specific surface area of 850 m$^2$/g, aluminium modified with sodium aluminate to a |

TABLE 1-continued

| | |
|---|---|
| | degree of 0.25% $Al_2O_3$, and S-value of 20% and silica content of 8.0% by weight. |
| Silica III | Silica sol of the type described in U.S. Pat. No. 6,083,997 having a molar ratio $SiO_2/Na_2O$ of 17 obtained by mixing water glass having a molar ratio $SiO_2:Na_2O$ of 3.4, a silica content of 15% by weight with polysilicic acid (PSA), having a silica content of 6.0% by weight. |

EXAMPLE 2

In the following examples test samples of naphthalene sulphonate formaldehyde condensate and silica-based particles in different dosages were added to a test stock to evaluate the performance of the composition as a drainage agent. The drainage performance was evaluated by means of a Dynamic Drainage Analyser (DDA), available from Akribi, Sweden. The DDA measures the time for draining a set volume of stock through a wire when removing a plug and applying vacuum to that side of the wire opposite to the side on which the stock is present.

In the examples a cationic polymer was added to the stock before the aqueous silica-containing compositions according to the invention or the anionic reference.

Test samples prepared from mixtures of NSF II and Silica I in different ratios, which were tested on a test stock, which was a wood containing stock having a pH of 7.6, a conductivity of 5.0 mS/cm, and a consistency of 1.43 g/l. The stock was stirred in a baffled jar at a speed of 1500 rpm throughout the test.

In the tests 20 kg/t (20 kg/tonne) of cationic starch (C1), which is a cationic potato starch with a nitrogen content of 0.5%, obtained by quarternisation of native potato starch with 3-chloro-2-hydroxypropyl dimethyl benzyl ammonium chloride was added to the stock, after 30 seconds of stirring the anionic mixture was added followed by 15 seconds stirring before drainage.

As reference silica I was used. All the samples were diluted to 0.5% of solids before the tests. Ratios and results are summarised in Table 2.

TABLE 2

| | | Dewatering times (sec.) at a dosage of: | | |
|---|---|---|---|---|
| Sample | Ratio | 1 kg/t | 2 kg/t | 3 kg/t |
| silica I | | 26.0 | 23.9 | 20.0 |
| NSF II + silica I | 0.25:1 | 25.5 | 19.1 | 15.3 |
| NSF II + silica I | 0.67:1 | 21.6 | 15.5 | 12.5 |
| NSF II + silica I | 1:1 | 20.4 | 14.9 | 12.7 |
| NSF II + silica I | 1.5:1 | 19.3 | 13.8 | 12.3 |
| NSF II + silica I | 4:1 | 17.0 | 12.3 | 13.3 |

EXAMPLE 3

Test samples were prepared from NSF II and silica II. As reference silica II was used. All the samples were diluted to 0.5% solids before the drainage evaluation, which was performed as in Example 2, with the same stock and with 20 kg/t of C1. Ratios and results are summarised in Table 3.

TABLE 3

| | | Dewatering times (sec.) at a dosage of: | | |
|---|---|---|---|---|
| Sample | Ratio | 1 kg/t | 2 kg/t | 3 kg/t |
| silica II | | 25.5 | 22.0 | 18.7 |
| NSF II + silica II | 0.25:1 | — | 17.1 | — |
| NSF II + silica II | 0.67:1 | — | 14.6 | — |
| NSF II + silica II | 1:1 | 20.4 | 13.0 | 11.1 |
| NSF II + silica II | 1.5:1 | 18.6 | 13.2 | 12.1 |
| NSF II + silica II | 4:1 | 16.1 | 12.7 | 12.1 |

EXAMPLE 4

Test samples were prepared from NSF I and Silica I. Silica I was used as reference. The samples were diluted to 0.5% solids and drainage tests were performed as in Example 1. To the test stock was added 20 kg/t of C1. The stock was a wood containing stock having a conductivity of 5.0 mS/cm, a consistency of 1.52 g/l and pH=7.8. The ratios and dewatering times are summarised in Table 4.

TABLE 4

| | | Dewatering times (sec.) at a dosage of: | | | |
|---|---|---|---|---|---|
| Sample | Ratio | 1 kg/t | 2 kg/t | 3 kg/t | 4 kg/t |
| silica I | | 34.0 | 29.2 | 25.8 | 24.0 |
| NSF I + silica I | 0.25:1 | 30.1 | 22.4 | 17.6 | 14.0 |
| NSF I + silica I | 0.67:1 | 26.9 | 17.7 | 13.3 | 12.2 |
| NSF I + silica I | 1:1 | 25.0 | 16.1 | 12.0 | 12.1 |
| NSF I + silica I | 1.5:1 | 22.1 | 14.6 | 12.5 | 13.0 |
| NSF I + silica I | 4:1 | 18.9 | 13.5 | 12.7 | 14.0 |

EXAMPLE 5

Test samples were prepared from NSF I and Silica I. Silica I was used as a reference. The preparation procedure was the same as in previous examples. The conductivity of the wood containing stock was only 0.5 mS/cm. The amount of C1 was 30 kg/t in all tests. The drainage time for cationic starch added alone was 22 seconds. The ratios and dewatering times are summarised in Table 5.

TABLE 5

| | | Dewatering times (sec.) at a dosage of: | | | |
|---|---|---|---|---|---|
| Sample | Ratio | 1 kg/t | 2 kg/t | 3 kg/t | 4 kg/t |
| silica I | | 19.1 | 16.0 | 13.2 | 9.7 |
| NSF I + silica I | 0.25:1 | 14.3 | 11.6 | 9.4 | 8.5 |
| NSF I + silica I | 0.67:1 | 14.3 | 10.0 | 9.2 | 8.2 |
| NSF I + silica I | 1:1 | 13.7 | 9.9 | 8.5 | 8.5 |
| NSF I + silica I | 1.5:1 | 12.2 | 9.9 | 8.7 | 8.6 |
| NSF I + silica I | 4:1 | 12.0 | 10.4 | 9.7 | 9.7 |

EXAMPLE 6

The test samples were prepared from NSF I and Silica I. As reference Silica I was used. The stock was wood containing having a conductivity of 5.0 mS/cm, a consistency of 1.52 g/l and pH=7.8. To the stock was 3 kg/t of a cationic polyacrylamide (C-PAM), which was prepared by polymerisation of acrylamide (90 mol %) and acryloxy-ethyl-dimethyl-benzyl ammonium chloride (10 mol %), and having a molecular weight about 6,000,000, added in the beginning of the test. After 30 seconds of stirring a compositions of NSF I and Silica I were added followed by 15 seconds of stirring before drainage. The NSF I and Silica I compositions were diluted to 0.5% solids and the C-PAM to 0.1% solids prior to addition to the stock. The ratios and dewatering times are summarised in Table 6.

TABLE 6

| Sample | Ratio | Dewatering times (sec.) at a dosage of: 0.5 kg/t | 1.0 kg/t |
|---|---|---|---|
| silica I | | 14.4 | 10.3 |
| NSF I + silica I | 0.25:1 | 11.2 | 8.9 |
| NSF I + silica I | 0.67:1 | 10.3 | 9.1 |
| NSF I + silica I | 1:1 | 10.0 | 9.5 |
| NSF I + silica I | 1.5:1 | 10.4 | 9.7 |

EXAMPLE 7

Test samples of compositions of NSF III and Silica I, and of NSF III and Silica III were prepared. A Drainage evaluation of the samples was performed as in previous Examples in a high conductivity stock with conductivity 5.0 mS/cm. C1 was added in an amount of 20 kg/t to the stock. The ratios and dewatering times are summarised in Table 7.

TABLE 7

| Sample | Ratio | Dewatering times (sec.) at a dosage of: 1 kg/t | 3 kg/t |
|---|---|---|---|
| NSF III + Silica III | 0.077:1 | 34.2 | 21.2 |
| NSF III + Silica III | 0.15:1 | 31.0 | 18.0 |
| NSF III + Silica I | 0.2:1 | 29.9 | 17.7 |
| NSF III + Silica III | 0.2:1 | 29.2 | 16.4 |
| NSF III + Silica I | 0.3:1 | 27.9 | 16.2 |
| NSF III + Silica III | 0.3:1 | 28.0 | 14.6 |

The results show that the aqueous silica -containing composition according to the invention have improved drainage properties.

EXAMPLE 8

Test samples of compositions of NSF I and Silica I, and of NSF III and Silica III were prepared. As reference Silica I and Silica III were used. A drainage evaluation of the samples was performed as in previous Examples in a high conductivity stock with conductivity 5.0 mS/cm. C1 was added in an amount of 20 kg/t to the stock. The dewatering times summarised in Table 8.

TABLE 8

| Sample | Ratio | Dewatering times (sec.) at a dosage of: 2 kg/t | 3 kg/t |
|---|---|---|---|
| Silica I | | 27.2 | 24.3 |
| Silica III | | 26.8 | 20.9 |
| NSF III + Silica III | 0.077:1 | 27.3 | 21.2 |
| NSF III + Silica III | 0.15:1 | 23.1 | 18.0 |
| NSF I + Silica I | 0.2:1 | 21.4 | 15.8 |
| NSF I + Silica I | 0.3:1 | 20.7 | 15.1 |
| NSF III + Silica III | 0.2:1 | 20.7 | 16.4 |
| NSF III + Silica III | 0.3:1 | 20.2 | 14.6 |

The results show that the aqueous silica -containing compositions according to the invention have improved drainage properties.

EXAMPLE 9

A high molecular weight anionic polyacrylamide (A-PAM), MW from about 10 to 20 millions, containing about 30 mole-% anionic groups, in form of a water-in-oil emulsion inverted and diluted with water to a concentration of 0.1%. The A-PAM was mixed with 0.1% of Silica I in three different ratios of A-PAM to Silica I of 2:1, 1:1 and 0.5:1. Compositions of NSF III and Silica III (a) was prepared by adding a diluted water glass (15% $SiO_2$ and ratio $SiO_2/Na_2O$=3.4) to NSF III (as 30% water solution) under agitation. To this mixture was polysilicic acid, with a concentration of 6.0% $SiO_2$ a pH of 2.5, added under agitation for 20 minutes. The polysilicic acid was prepared from diluted waterglass that was run through a column filed with hydrogen saturated, strongly cationic, ion exchange resin.

NSF III/Silica III (b) mixture was prepared mixing NSF III with polysilicic acid under agitation for 5 minutes and then this mixture was added to waterglass under agitation for 20 minutes.

A drainage evaluation of the samples of this example were performed on a high conductivity stock (5.0 m S/cm). A cationic starch (C2), which was a cationic potato starch with a nitrogen content of 0.7%, obtained by quarternisation of native potato starch with 3-chloro-2-hydroxypropyl dimethyl benzyl ammonium chloride, was added before the anionic mixtures to the stock. C2 was added in an amount of 12 kg/t. The following dewatering times were obtained:

TABLE 9

| Sample | Ratio | Dewatering times (sec.) at a dosage of 2.0 kg/t |
|---|---|---|
| A-PAM | | 33.0 |
| Silica I | | 16.9 |
| A-PAM/Silica I | 0.5:1 | 28.7 |
| A-PAM/Silica I | 1:1 | 25.5 |
| A-PAM/Silica I | 2:1 | 29.4 |
| NSF III/Silica III a | 0.38:1 | 22.0 |
| NSF III/Silica III a | 1.9:1 | 21.0 |
| NSF III/Silica III a | 9:1 | 17.7 |
| NSF III/Silica III b | 0.5:1 | 23.0 |
| NSF III/Silica III b | 9:1 | 16.8 |

EXAMPLE 10

The storage stability of different mixtures of NSF and silica were determined. Samples of NSF was desalinated by the use of ultrafiltration (NSF I) to a conductivity of 12 mS/cm measured at 10% by weight of solids before mixing with silica to form aqueous compositions. Untreated NSF III were mixed with silica for comparison. All obtained aqueous compositions and the reference samples were stored according to the following procedure:

In a refrigerator for 9 weeks; then in oven at a temperature of 40° C. for 3 weeks;

in oven at a temperature of 60° C. for 1 week; and in oven at a temperature of 80° C. for 6 weeks.

The total storage time was 20 weeks. The storage times for the test samples are summarised in Table 10.

TABLE 10

| Sample | Ratio | Active substance ($SiO_2$ + NSF) | Time of gel formation |
|---|---|---|---|
| NSF III + Silica III | 0.15:1 | 7.2% | gel after 14 weeks |
| NSF I + Silica III | 0.15:1 | 7.2% | no gel after 20 weeks |
| NSF I + Silica III | 0.2:1 | 7.3% | no gel after 20 weeks |

The samples with no gel formation show better stability than the samples with gel—formation, and they did not even show an increase in viscosity.

EXAMPLE 11

Test samples of mixtures of NSF III/Silica I and of mixtures of NSF III/Silica III were prepared. As reference Silica III was used. A DDA evaluation of the samples was performed in a high conductivity stock with conductivity 5.0 mS/cm. C1 was added in an amount of 20 kg/t to the stock. The dewatering times summarised in Ta ble 11.

TABLE 11

| Sample | Dewatering times (seconds) 1 kg/t |
|---|---|
| Silica sol III | 32.1 |
| Silica sol III with 7.7% NSF III | 34.2 |
| Silica sol I with 7.7% NSF III | 29.4 |
| Silica sol III with 15% NSF III | 31.0 |
| Silica sol I with 15% NSF III | 30.7 |

The results show that the mixtures containing Silica I have received improved dewatering times compared to Silica III. Silica I is an alkali stabilised silica sol.

The invention claimed is:

1. A process for the production of paper from a suspension containing cellulosic fibres, and optionally fillers, comprising adding to the suspension at least one cationic organic polymer and an aqueous silica-containing composition comprising an anionic naphthalene sulphonate formaldehyde condensate and anionic silica-based particles, the composition having a weight ratio of naphthalene sulphonate formaldehyde condensate to total amount of silica-based particles within the range of from 0.2:1 to 99:1, and containing naphthalene sulphonate formaldehyde condensate and total amount of silica-based particles in an amount of at least 0.01% by weight, based on the total weight of the aqueous silica-containing composition, and with the proviso that the composition contains substantially no cellulose-reactive sizing agent.

2. The process according to claim 1, wherein the anionic naphthalene sulphonate formaldehyde condensate has a conductivity of less than 20 mS/cm.

3. The process according to claim 1, wherein the anionic naphthalene sulphonate formaldehyde condensate has a conductivity of less than 15 mS/cm.

4. The process according to claim 1, wherein the aqueous silica-containing composition has a weight ratio of naphthalene sulphonate formaldehyde condensate to total amount of silica-based particles within the range of from 0.2:1 to 90:1.

5. The process according to claim 1, wherein the anionic silica-based particles have a specific surface area within the range of from 300 to 1300 $m^2/g$.

6. The process according to claim 1, wherein the cationic organic polymer has at least one aromatic group.

7. A process for the production of paper from a suspension containing cellulosic fibres, and optionally fillers, comprising adding to the suspension at least one cationic organlc polymer and an aqueous silica-containing composition comprising en anionic naphthalene sulphonate formaldehyde condensate and anionic silica-based particles, the composition having a weight ratio of naphthalene sulphonate formaldehyde condensate to total amount of silica-based particles within the range of from 0.2:1 to 99:1, and containing naphthalene sulphonate formaldehyde condensate and total amount of silica-based particles in an amount of at least 0.01% by weight, based on the total weight of the aqueous silica-containing composition, and with the proviso that the composition contains substantially no cellulose-reactive sizing agent, wherein the cationic organic polymer is cationic starch or catlonic polyacrylamide.

8. The process according to claim 7, wherein the cationic organic polymer has at least one aromatic group.

9. The process according to claim 7, wherein the anionic silica-based particles are aggregated or microgel formed silica-based particles.

10. The process according to claim 7, wherein the anionic naphthalene sulphonate formaldehyde condensate has a conductivity of less than 20 mS/cm.

11. The process according to claim 7, wherein the anionic naphthalene sulphonate formaldehyde condensate has a conductivity of less than 15 mS/cm.

12. The process according to claim 7, wherein the aqueous silica-containing composition has a weight ratio of naphthalene sulphanate formaldehyde condensate to total amount of silica-based particles within the range of from 0.2:1 to 90:1.

13. The process according to claim 7, wherein the anionic silica-based particles have a specific surface area within the range of from 300 to 1300 $m^2/g$.

14. A process for the production of paper from a suspension containing cellulosic fibres, and optionally fillers, comprising adding to the suspension at least one cationic organic polymer and an aqueous silica-containing composition comprising an anionic naphthalene sulphonate formaldehyde condensate and aggregated or microgel formed anionic silica-based particles, the composition having a weight ratio of naphthalene sulphonate formaldehyde condensate to total amount of silica-based particles within the range of from 0.2:1 to 99:1, and containing naphthalene sulphonate formaldehyde condensate and total amount of silica-based particles in an amount of at least 0.01% by weight, based on the total weight of the aqueous silica-containing composition, and with the proviso that the composition contains substantially no cellulose-reactive sizing agent.

15. The process according to claim 14, wherein the anionic naphthalene sulphonate formaldehyde condensate has a conductivity of less than 20 mS/cm.

16. The process according to claim 14, wherein the anionic naphthalene sulphonate formaldehyde condensate has a conductivity of less than 15 mS/cm.

17. The process according to claim 14, wherein the aqueous silica-containing composition has a weight ratio of naphthalene sulphonate formaldehyde condensate to total amount of silica-based particles within the range of from 0.2:1 to 90:1.

18. The process according to claim 14, wherein the anionic silica-based particles have a specific surface area within the range of from 300 to 1300 $m^2/g$.

19. The process according to claim 14, wherein the cationic organic polymer is cationic starch or catlonic polyacrylamide.

20. The process according to claim 14, wherein the cationic organic polymer has at least one aromatic group.

* * * * *

UNITED STATES PATENT AND TRADEMARK OFFICE

CERTIFICATE OF CORRECTION

PATENT NO. : 7,156,955 B2
APPLICATION NO. : 10/326316
DATED : January 2, 2007
INVENTOR(S) : Nyander et al.

It is certified that error appears in the above-identified patent and that said Letters Patent is hereby corrected as shown below:

Column 14

Line 1
"organlc" should read -- organic --

Line 3
"en" should read -- an --

Line 14
"catlonic" should read -- cationic --

Signed and Sealed this

First Day of May, 2007

JON W. DUDAS
*Director of the United States Patent and Trademark Office*